US006042085A

United States Patent [19]

Tang

[11] Patent Number: 6,042,085

[45] Date of Patent: Mar. 28, 2000

[54] JACK FOR EXTENDING THE LIFTING PISTON QUICKLY

[76] Inventor: Kun-Jui Tang, No. 269, Sec. 2, An-Ho Rd., Tainan, Taiwan

[21] Appl. No.: 09/212,115

[22] Filed: Dec. 15, 1998

[51] Int. Cl.[7] ..... B66F 3/24

[52] U.S. Cl. ..... 254/93 H

[58] Field of Search ..... 254/93 H, 8 B, 254/11, 423, 89 H, 93 R

[56] References Cited

U.S. PATENT DOCUMENTS

| | | | |
|---|---|---|---|
| 1,610,499 | 12/1926 | Dybens | 254/93 H |
| 2,809,494 | 10/1957 | Matson | 254/93 R |
| 3,822,966 | 7/1974 | McClocklin | 254/93 H |
| 5,524,868 | 6/1996 | Decker et al. | 254/93 H |

*Primary Examiner*—David A. Scherbel
*Assistant Examiner*—Daniel G. Shanley
*Attorney, Agent, or Firm*—Kolisch Hartwell Dickinson McCormack & Heuser

[57] ABSTRACT

A jack includes a base member having a first chamber in which a piston is received, a main cylinder connected to base member and having a tube extending therein to which the lifting piston is movably mounted, a casing mounted to the main cylinder so as to define a second chamber between the casing and the main cylinder. A first path connects the second chamber and the first chamber and a second path connects the first chamber and the tube so that fluid enters into the tube to extend the lifting piston by operating the piston. A protection path extends between the outside of the base member and the second path with a first branch path and a second branch path respectively extending from the protection path and connecting the second chamber and the interior of the main cylinder. The pressure in the tube can be released by unscrewing the bolt threadedly engaged with the protection path so as to let the fluid enter into the second chamber and the interior of the main cylinder.

2 Claims, 5 Drawing Sheets

JACK FOR EXTENDING THE LIFTING PISTON QUICKLY

FIELD OF THE INVENTION

The present invention relates to a jack, and more particularly, to an improved jack whose lifting piston can be extended or retracted directly and quickly. The pressure in the interior chamber can be released by loosening the protection bolt.

BACKGROUND OF THE INVENTION

A conventional jack employs hydraulic power to extend or retract the lifting piston which has a supporting member connected to the distal end thereof so as to engage with an object so that the object can be lifted by extending the lifting piston. The jack has a lever which is moved up and down to push the fluid in the paths in the jack to extend or retract the lifting piston. The lifting piston is extended very slowly because the volume of the fluid entering the paths of the jack is determined by the reciprocation of the lever. Each cycle of the lever makes the lifting piston move a certain distance so that the cylinder is moved at a fixed speed regardless of the load on the lifting piston. Therefore, even if the lifting piston is required to be extended or retracted in an emergency, there is no other way for the conventional jack to do this except by operating the lever step by step. This takes time and could result in a disaster.

The present invention intends to provide a jack whose lifting piston can be extended or retracted quickly by operating the lever so that the jack is helpful in practical use and saves time. The jack in accordance with the present invention has arisen to mitigate the disadvantage of the conventional jack.

SUMMARY OF THE INVENTION

In accordance with one aspect of the present invention, there is provided a jack comprising a base member having a first chamber in which a first piston is movably received which is pivotally connected to a lever which is pivotally connected to the base member. A main cylinder is attached to the base member and has a lifting piston movably received therein which has a tube extending from the base member received therein.

A casing is mounted to the main cylinder so as to define a second chamber between the main cylinder and the casing. A first path connects the second chamber and the first chamber with a first check valve received therein so as to normally close the first path in the direction from the first chamber to the second chamber. A second path connects the first chamber and the passage in the lifting piston via a tube and has a second check valve received therein to normally close the second path in the direction from the tube to the first chamber. A third path connects the second chamber and the interior of the main cylinder with a third check valve received therein to normally close the third path in the direction from the interior of the main cylinder to the second chamber.

A protection path connects to the second path and has a first section, a second section and a third section. A fourth check valve is received in the second section to normally close the first section in the direction from the second section to the first section, a fifth check valve received in the third section to normally close the second section from the third section to the second section. A first branch path communicates with the interior of the main cylinder and the section, a second branch path communicating with the third section and the second chamber. A bolt is threadedly engaged with the third section and engaged with the fifth check valve, the pressure in the tube can be released by adjusting the bolt so that fluid in the tube enters to the interior of the main cylinder and/or the second chamber via the protection path, the first branch path and the second branch path.

The main object of the present invention is to provide a jack whose pressure can be quickly released and the lifting piston can be extended or retracted within a short period of time.

Further objects, advantages, and features of the present invention will become apparent from the following detailed description with appropriate reference to the accompanying drawings.

DETAILED DESCRIPTION OF THE PREFERRED EMBODIMENT

Figure 1:
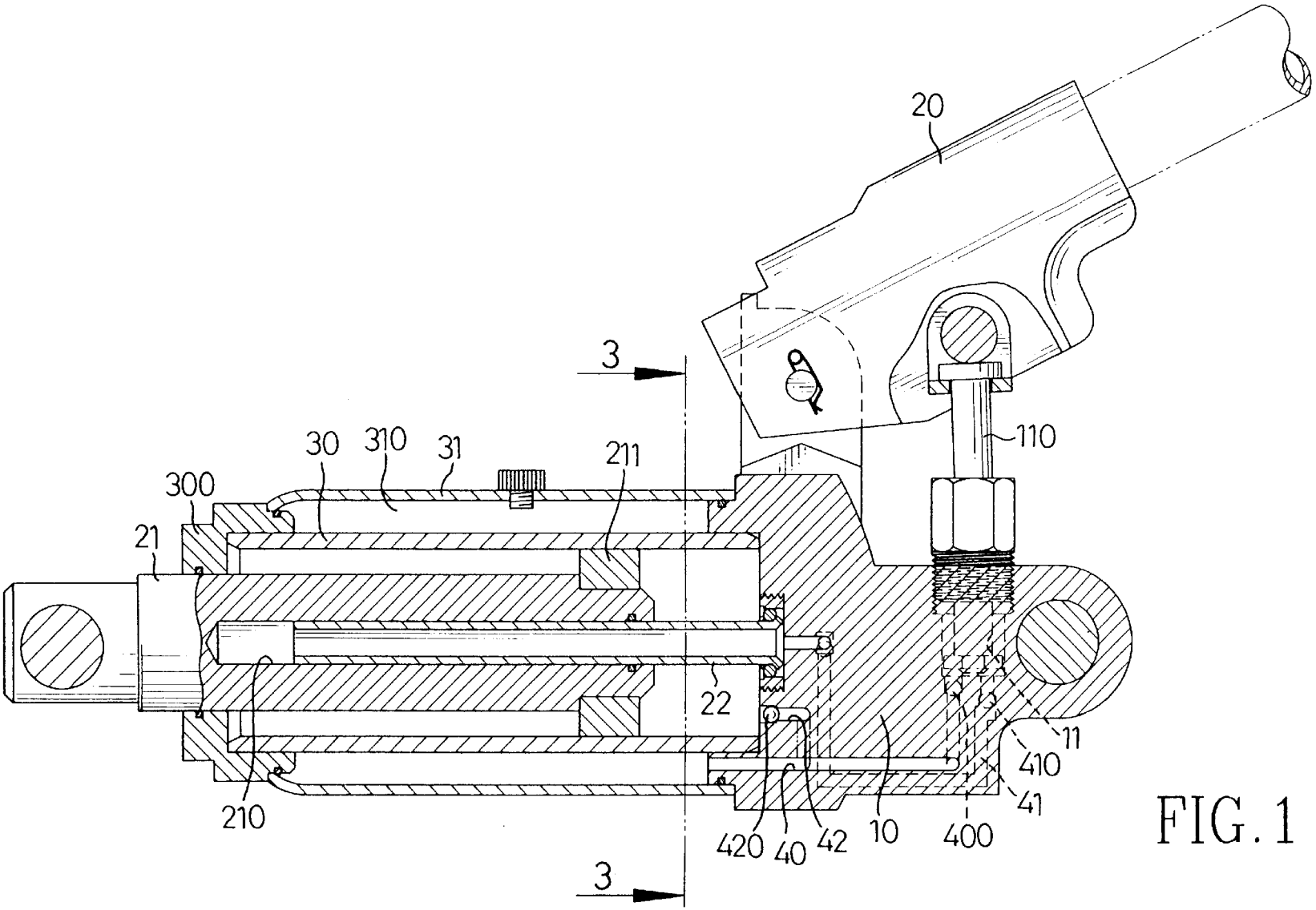
FIG. 1 is a side elevational view, partly in section, of the jack in accordance with the present invention, wherein the lever is lifted and the fluid in the second chamber is sucked into the first chamber.
Figure 2:
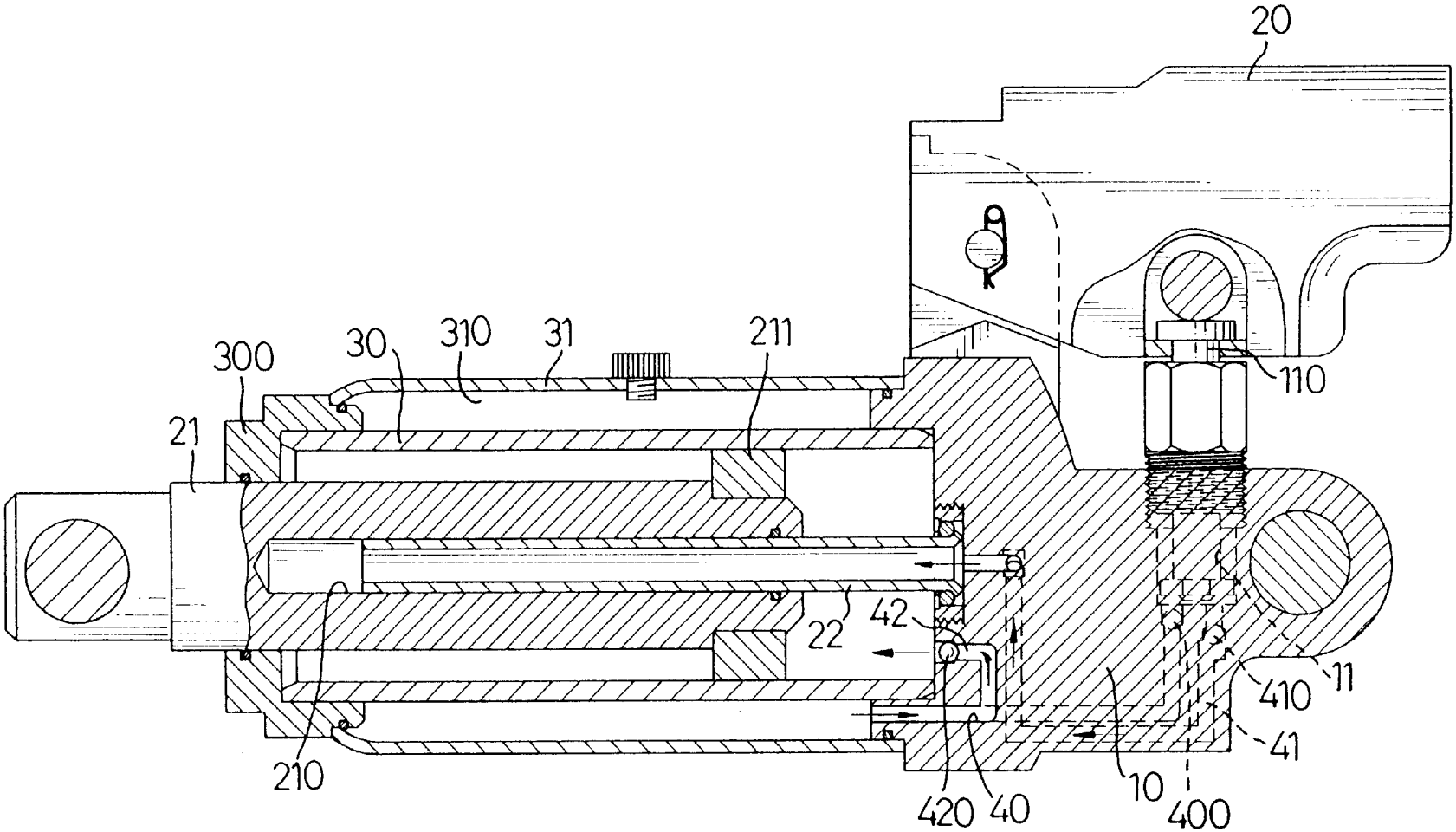
FIG. 2 is a side elevational view, partly in section, of the jack in accordance with the present invention, wherein the lever is pushed and the fluid in the first chamber enters into the tube and the fluid in the second chamber is sucked into the interior of the main cylinder via the third path.
Figure 3:
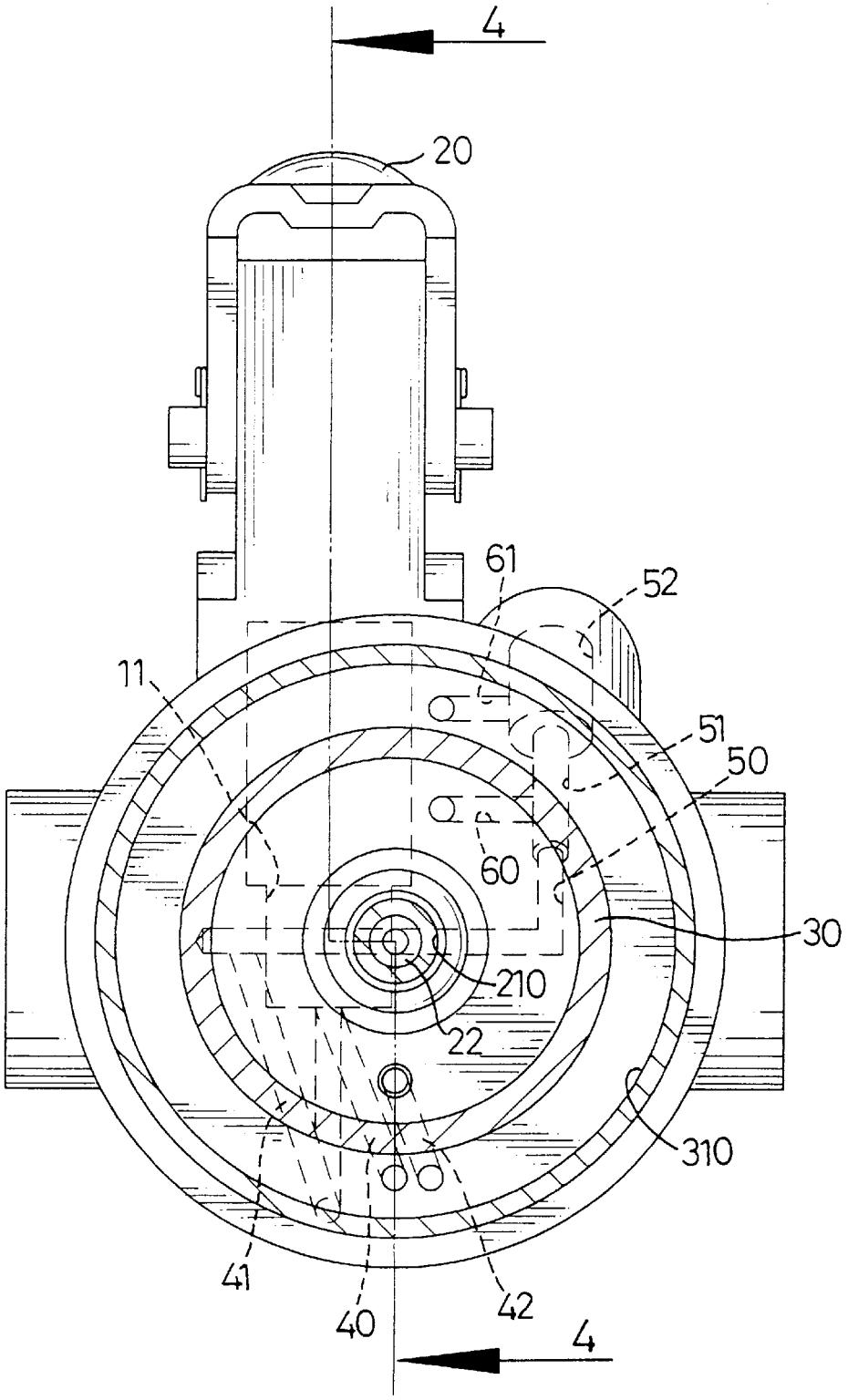
FIG. 3 is an illustrative view to show the arrangement of the paths in the base member of the jack.

For a better understanding of the present invention, reference is made to FIGS. 1 and 2 wherein the jack in accordance with the present invention comprises a base member (10) having a first chamber (11) defined therein for a first piston (110) movably received therein which is pivotally connected to a lever (20) which is pivotally connected to the base member (10) so that the lever (20) can be lifted and pushed relative to the base member (10).

A main cylinder (30) is connected to the base member (20) and has a lifting piston (21) movably received therein which has a passage (210) defined centrally therein so as to receive a tube (22) extending from the base member (10). The lifting piston (21) has a piston ring (211) mounted thereto which is movable along the inside of the main cylinder (30). A collar (300) is mounted to the main cylinder (30) and the lifting piston (21) movably extends through the collar (300). A casing (31) is connected between the collar (30) and the base member (10) so as to define a second chamber (310) between the main cylinder (30) and the casing (31).

A first path (40) communicates between the second chamber (310) and the first chamber (11) with a first check valve (400) in the first path (40) to normally close the first path (40) in the direction from the first chamber (11) to the second chamber (310). A second path (41) communicates with the first chamber (11) and the passage (210) via a second check valve (410) in the second path (41) to normally close the second path (41) in the direction from the tube (22) to the first chamber (11). A third path (42) (further referring to FIG.

3) communicates with the second chamber (310) and the interior of the main cylinder (30) with a third check valve (420) in the third path (42) to normally close the third path (42) from the interior of the main cylinder (30) to the second chamber (310).

Therefore, when using the jack, the lever (20) is lifted and the fluid in the second chamber (310) is sucked into the first chamber (11) via the first path (40) wherein the first check valve (400) is sucked upward to allow the fluid to enter into the first chamber (11). The lever (20) is then pushed downward to compress the fluid in the first chamber (11) to push the second check valve (410) downward to open the second path (41) so that the fluid flows into the tube (22) via the second path (41) to extend the lifting piston (21). Because the space in the passage (210) is small, the lifting piston (21) will be very quickly extended by the force of the fluid, which results in a vacuum inside the main cylinder (30) in the space between the piston ring (211) and the base member (10) which causes the third check valve (420) to open the third path (42) so that more fluid in the second chamber (310) will enter into the interior of the main cylinder (30) to push the piston ring (211) and quickly extend the lifting piston (21).

Figure 4:
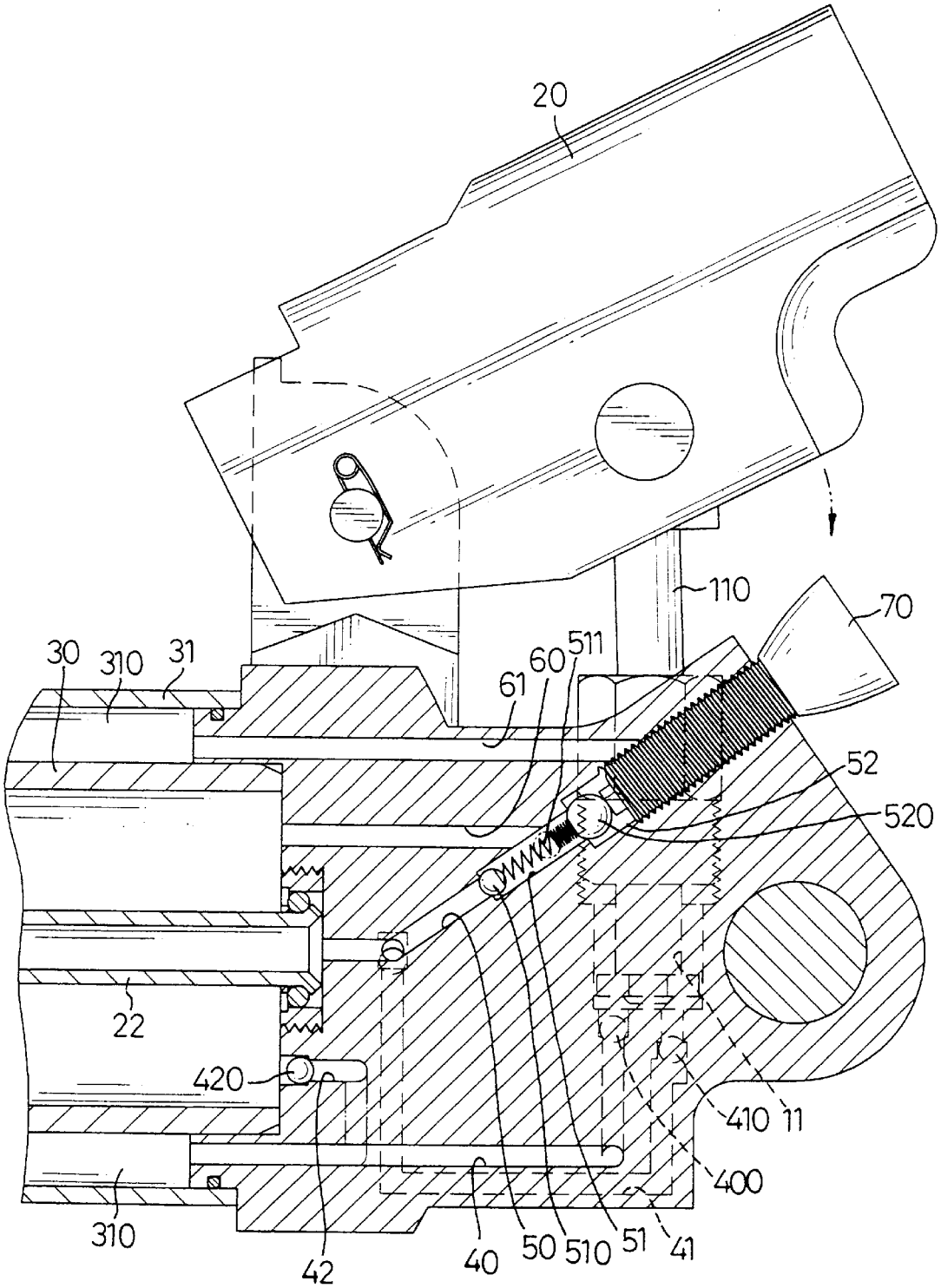
FIG. 4 is an enlarged cross-sectional view to show the protection path and the bolt in the base member.
Figure 5:
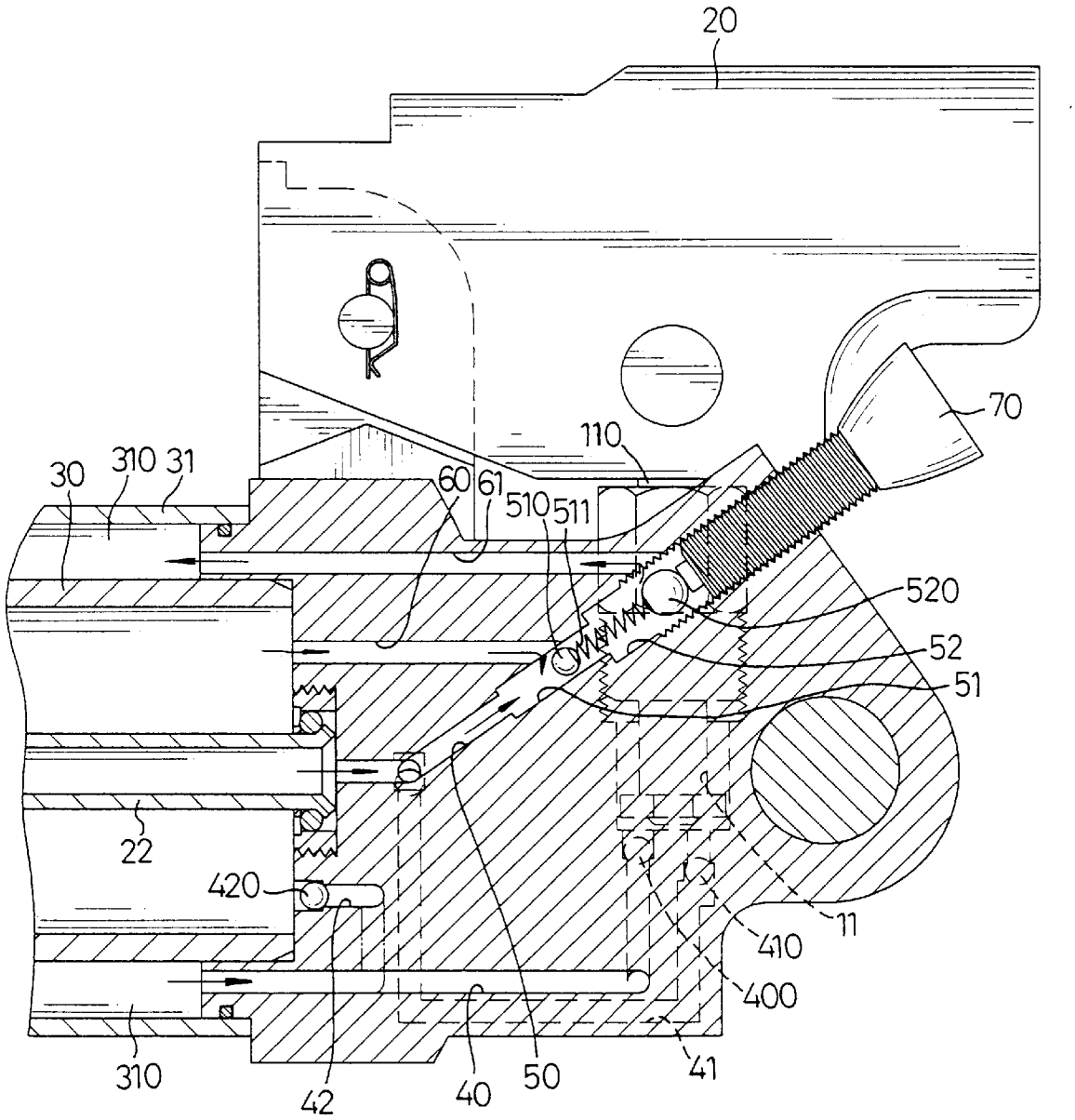
FIG. 5 is an enlarged cross-sectional view to show the fluid in the tube released into the interior of the main cylinder and the second chamber via the protection path.

Referring to FIGS. 4 and 5, a protection path extends through the base member (10) and communicates with the second path (41) and has a first section (50), a second section (51) and a third section (52), wherein the first section (50), the second section (51) and the third section (52) share a common longitudinal axis. A fourth check valve (510) is received in the second section to normally close the first section (50) in the direction from the second section (51) to the first section (50) and a fifth check valve (520) is received in the third section to normally close the second section (51) in the direction from the third section (52) to the second section (51). The fourth check valve (510) and the fifth check valve (520) are balls, and a first spring (511) is biased between the fourth check valve (510) and the fifth check valve (520). A bolt (70) is threadedly engaged with the third section (52) and engaged with the fifth check valve (520) so that the force applied to the fourth check valve (510) by the spring (511) can be adjusted by rotating the bolt (70). A first branch path (60) connects the interior of the main cylinder (30) and the second section (51), and a second branch path (61) connects the third section (52) and the second chamber (310). Accordingly, when the pressure in the tube (22) or the passage (210) is overloaded, or the lifting piston (21) must be retracted quickly, the bolt (70) is threadedly loosened from the third section (52) of the protection path so that the fluid will push the fourth check valve (510) to let the fluid in the interior of the main cylinder (30) flow out via the first branch path (60) as shown in FIG. 5. If the bolt (70) is retracted from the base member (10) enough, the second branch path (61) is opened to the third section (52) so that the fluid will be quickly removed from the tube (22) and the interior of the main cylinder (30) via the first branch path (60) and the second branch path (61).

In the jack of the present invention, the lifting piston (21) can be extended and retracted quickly, and the process for releasing the pressure in the tube (22) can be conveniently initiated by simply loosening the bolt (70).

Although the invention has been explained in relation to its preferred embodiment, it is to be understood that many other possible modifications and variations can be made without departing from the spirit and scope of the invention as hereinafter claimed.

What is claimed is:

1. A jack comprising:

a base member (10) having a first chamber (11) defined therein, a first piston (110) movably received in said first chamber (11) and pivotally connected to a lever (20) which is pivotally connected to said base member (10);

a main cylinder (30) connected to said base member (20) and having a lifting piston (21) movably received therein which has a passage (210) defined centrally therein, said lifting piston (21) having a piston ring (211) mounted thereto which is movable along the inside of said main cylinder (30), a tube (22) extending from said base member (20) and inserted into said passage (210);

a collar (300) mounted to said lifting piston (21) and a casing (31) connected between said collar (300) and said base member (10) so as to define a second chamber (310) between said main cylinder (30) and said casing (31);

a first path connecting said second chamber (310) and said first chamber (11), a second path (41) connecting said first chamber (11) and said passage (210), a third path (42) connecting said second chamber (310) and the interior of said main cylinder (30), a first check valve (400) received in said first path (40) to normally close said first path (40) in the direction from said first chamber (11) to said second chamber (310), a second check valve (410) received in said second path (41) to normally close said second path (41) in the direction from said tube (22) to said first chamber (11), a third check valve (420) received in said third path (42) to normally close said third path (42) in the direction from the interior of said main cylinder (30) to said second chamber (310);

a protection path extending through said base member (10) and connecting to said second path (41) and having a first section (50), a second section (51) and a third section (52), a fourth check valve (510) received in said second section (51) to normally close said first section (50) in the direction from said second section (51) to said first section (50), a fifth check valve (520) received in said third section to normally close said second section (51) in the direction from said third section (52) to said second section (51);

a first branch path (60) connecting the interior of said main cylinder (30) and said second section (51), a second branch path (61) connecting said third section (52) and said second chamber (310), and a bolt (70) threadedly engaged with said third section (52) and engaged with said fifth check valve (520).

2. The jack as claimed in claim 1, wherein said fourth check valve (510) and said fifth check valve (520) are balls, and a first spring (511) is biased between said fourth check valve (510) and said fifth check valve (520).

* * * * *